US010178475B1

(12) United States Patent
Stefanakis et al.

(10) Patent No.: US 10,178,475 B1
(45) Date of Patent: Jan. 8, 2019

(54) FOREGROUND SIGNAL SUPPRESSION APPARATUSES, METHODS, AND SYSTEMS

(71) Applicant: Foundation for Research and Technology—Hellas (FORTH), Heraklion, Crete (GR)

(72) Inventors: Nikolaos Stefanakis, Heraklion (GR); Athanasios Mouchtaris, Heraklion (GR)

(73) Assignee: FOUNDATION FOR RESEARCH AND TECHNOLOGY—HELLAS (F.O.R.T.H.), Heraklion (GR)

( * ) Notice: Subject to any disclaimer, the term of this patent is extended or adjusted under 35 U.S.C. 154(b) by 9 days.

(21) Appl. No.: 15/183,573

(22) Filed: Jun. 15, 2016

Related U.S. Application Data

(63) Continuation of application No. 15/001,221, filed on Jan. 19, 2016, now abandoned, which is a (Continued)

(51) Int. Cl.
*H04R 3/00* (2006.01)
*H04R 29/00* (2006.01)

(52) U.S. Cl.
CPC ..... *H04R 3/005* (2013.01); *H04R 29/005* (2013.01); *H04R 2430/03* (2013.01); *H04R 2430/23* (2013.01)

(58) Field of Classification Search
CPC .. H04R 3/005; H04R 29/005; H04R 2430/03; H04R 2430/23
See application file for complete search history.

(56) References Cited

U.S. PATENT DOCUMENTS 7,555,161 B2 6/2009 Haddon et al.
7,826,623 B2 * 11/2010 Christoph ..... H04R 1/406 367/118

(Continued)

OTHER PUBLICATIONS

H. K. Maganti, D. Gatica-Perez, I. McCowan, "Speech Enhancement and Recognition in Meetings with an Audio-Visual Sensor Array," IEEE Transactions on Audio, Speech, and Language Processing, vol. 15, No. 8, Nov. 2007.

(Continued)

*Primary Examiner* — Regina N Holder
(74) *Attorney, Agent, or Firm* — Norton Rose Fulbright US LLP

(57) ABSTRACT

A processor-implemented method for foreground signal suppression. The method includes: capturing a plurality of input signals using a plurality of sensors within a sound field; subjecting each input signal to a short-time Fourier transform to transform each signal into a plurality of non-overlapping subband regions; estimating the diffuseness of the sound field based on the plurality of input signals; decomposing each of the plurality of input signals into a diffuse component and a directional component based on the diffuseness estimate; applying a spatial analysis operation to filter the directional component of each of the plurality of input signals, wherein the spatial analysis operation includes applying a set of beamformers to the directional components to produce a plurality of beamformer signals; and processing the plurality of beamformer signals to decompose the signal into a foreground channel and a background channel.

17 Claims, 4 Drawing Sheets

Related U.S. Application Data continuation-in-part of application No. 14/556,038, filed on Nov. 28, 2014, now Pat. No. 9,549,253, which is a continuation-in-part of application No. 14/294,095, filed on Jun. 2, 2014, which is a continuation-in-part of application No. 14/038,726, filed on Sep. 26, 2013, now Pat. No. 9,554,203.

(60) Provisional application No. 62/104,605, filed on Jan. 16, 2015, provisional application No. 61/909,882, filed on Nov. 27, 2013, provisional application No. 61/829,760, filed on May 31, 2013, provisional application No. 61/706,073, filed on Sep. 26, 2012.

(56) References Cited

U.S. PATENT DOCUMENTS

| | | | | |
|---|---|---|---|---|
| 8,073,287 | B1 | 12/2011 | Wechsler et al. | |
| 8,923,529 | B2 | 12/2014 | McCowan | |
| 2008/0089531 | A1 | 4/2008 | Koga et al. | |
| 2009/0080666 | A1 | 3/2009 | Uhle et al. | |
| 2010/0135511 | A1 | 6/2010 | Pontoppidan | |
| 2010/0142327 | A1 | 6/2010 | Kepesi et al. | |
| 2010/0217590 | A1 | 8/2010 | Nemer et al. | |
| 2010/0278357 | A1 | 11/2010 | Hiroe | |
| 2011/0033063 | A1 | 2/2011 | McGrath et al. | |
| 2011/0091055 | A1 | 4/2011 | LeBlanc | |
| 2011/0110531 | A1 | 5/2011 | Klefenz et al. | |
| 2012/0020485 | A1 | 1/2012 | Visser et al. | |
| 2012/0051548 | A1* | 3/2012 | Visser | G10L 21/0208 381/56 |
| 2012/0114126 | A1 | 5/2012 | Thiergart et al. | |
| 2012/0140947 | A1 | 6/2012 | Shin | |
| 2012/0221131 | A1 | 8/2012 | Wang et al. | |
| 2013/0108066 | A1 | 5/2013 | Hyun et al. | |
| 2013/0142343 | A1* | 6/2013 | Matsui | G10L 21/028 381/56 |
| 2013/0216047 | A1 | 8/2013 | Kuech et al. | |
| 2013/0259243 | A1* | 10/2013 | Herre | G10L 19/02 381/57 |
| 2013/0268280 | A1 | 10/2013 | Del Galdo et al. | |
| 2013/0272548 | A1 | 10/2013 | Visser et al. | |
| 2013/0287225 | A1 | 10/2013 | Niwa et al. | |
| 2014/0025374 | A1* | 1/2014 | Lou | G10L 21/0216 704/203 |
| 2014/0172435 | A1 | 6/2014 | Thiergart et al. | |
| 2014/0376728 | A1 | 12/2014 | Rämö et al. | |
| 2015/0310857 | A1 | 10/2015 | Habets et al. | |

OTHER PUBLICATIONS

B. Loesch et al., "Multidimensional localization of multiple sound sources using frequency domain ICA and an extended state coherence transform," *IEEE/SP 15th Workshop Statistical Signal Processing* (*SSP*), pp. 677-680, Sep. 2009.

A. Lombard et al., "TDOA estimation for multiple sound sources in noisy and reverberant environments using broadband independent component analysis," *IEEE Transactions on Audio, Speech, and Language Processing*, pp. 1490-1503, vol. 19, No. 6, Aug. 2011.

H. Sawada et al., "Multiple source localization using independent component analysis," *IEEE Antennas and Propagation Society International Symposium*, pp. 81-84, vol. 4B, Jul. 2005.

F. Nesta and M. Omologo, "Generalized state coherence transform for multidimensional TDOA estimation of multiple sources," *IEEE Transactions on Audio, Speech, and Language Processing*, pp. 246-260, vol. 20, No. 1 , Jan. 2012.

M. Swartling et al., "Source localization for multiple speech sources using low complexity non-parametric source separation and clustering," in *Signal Processing*, pp. 1781-1788, vol. 91, Issue 8, Aug. 2011.

C. Blandin et al., "Multi-source TDOA estimation in reverberant audio using angular spectra and clustering," in *Signal Processing*, vol. 92, No. 8, pp. 1950-1960, Aug. 2012.

D. Pavlidi et al., "Real-time multiple sound source localization using a circular microphone array based on single-source confidence measures," in *International Conference on Acoustics, Speech and Signal Processing* (*ICASSP*), pp. 2625-2628, Mar. 2012.

O. Yilmaz and S. Rickard, "Blind separation of speech mixtures via time-frequency masking," *IEEE Transactions on Audio, Speech, and Language Processing*, pp. 1830-1847, vol. 52, No. 7, Jul. 2004.

E. Fishler et al., "Detection of signals by information theoretic criteria: General asymptotic performance analysis," in *IEEE Transactions on Signal Processing*, pp. 1027-1036, vol. 50, No. 5, May 2002.

M. Puigt and Y. Deville, "A new time-frequency correlation-based source separation method for attenuated and time shifted mixtures," in *8th International Workshop on Electronics, Control, Modelling, Measurement and Signals 2007 and Doctoral School* (*EDSYS,GEET*), pp. 34-39, May 28-30, 2007.

G. Hamerly and C. Elkan, "Learning the k in k-means," in *Neural Information Processing Systems*, Cambridge, MA, USA: MIT Press, pp. 281-288, 2003.

B. Loesch and B. Yang, "Source number estimation and clustering for underdetermined blind source separation," in *Proceedings International Workshop Acoustic Echo Noise Control* (*IWAENC*), 2008.

S. Araki et al., "Stereo source separation and source counting with MAP estimation with dirichlet prior considering spatial aliasing problem," in *Independent Component Analysis and Signal Separation, Lecture Notes in Computer Science*. Berlin/Heidelberg, Germany: Springer , vol. 5441, pp. 742-750, 2009.

A. Karbasi and A. Sugiyama, "A new DOA estimation method using a circular microphone array," in *Proceedings European Signal Processing Conference* (*EUSIPCO*), 2007, pp. 778-782.

S. Mallat and Z. Zhang, "Matching pursuit with time-frequency dictionaries," *IEEE Transactions on Signal Processing*, vol. 41, No. 12, pp. 3397-3415, Dec. 1993.

D. Pavlidi et al., "Source counting in real-time sound source localization using a circular microphone array," in *Proc. IEEE 7th Sensor Array Multichannel Signal Process. Workshop* (*SAM*), Jun. 2012, pp. 521-524.

A. Griffin et al., "Real-time multiple speaker DOA estimation in a circular microphone array based on matching pursuit," in *Proceedings 20th European Signal Processing Conference* (*EUSIPCO*), Aug. 2012, pp. 2303-2307.

P. Comon and C. Jutten, Handbook of Blind Source Separation: Independent Component Analysis and Applications, ser. Academic Press. Burlington, MA: Elsevier, 2010.

M. Cobos et al., "On the use of small microphone arrays for wave field synthesis auralization," *Proceedings of the 45th International Conference: Applications of Time-Frequency Processing in Audio Engineering Society Conference*, Mar. 2012.

H. Hacihabiboglu and Z. Cvetkovic, "Panoramic recording and reproduction of multichannel audio using a circular microphone array," in *Proceedings of the IEEE Workshop on Applications of Signal Processing to Audio and Acoustics* (*WASPAA 2009*), pp. 117-120, Oct. 2009.

K. Niwa A. et al., "Encoding large array signals into a 3D sound field representation for selective listening point audio based on blind source separation," in *Proceedings of the IEEE International Conference on Acoustics, Speech and Signal Processing* (*ICASSP 2008*), pp. 181-184, Apr. 2008.

V. Pulkki, "Spatial sound reproduction with directional audio coding," *Journal of the Audio Engineering Society*, vol. 55, No. 6, pp. 503-516, Jun. 2007.

F. Kuech et al., "Directional audio coding using planar microphone arrays," in Proceedings of the Hands-free Speech Communication and Microphone Arrays (HSCMA), pp. 37-40, May 2008.

O. Thiergart et al., "Parametric spatial sound processing using linear microphone arrays," in *Proceedings of Microelectronic Systems*, A. Heuberger, G. Elst, and R.Hanke, Eds., pp. 321-329, Springer, Berlin, Germany, 2011.

(56) References Cited

OTHER PUBLICATIONS

M. Kallinger et al., "Enhanced direction estimation using microphone arrays for directional audio coding," in *Proceedings of the Hands-free Speech Communication and Microphone Arrays* (*HSCMA*), pp. 45-48, May 2008.
M. Cobos et al., "A sparsity-based approach to 3D binaural sound synthesis using time-frequency array processing," *Eurasip Journal on Advances in Signal Processing*, vol. 2010, Article ID 415840, 2010.
L.M. Kaplan et al., "Bearings-only target localization for an acoustical unattended ground sensor network," *Proceedings of Society of Photo-Optical Instrumentation Engineers* (*SPIE*), vol. 4393, pp. 40-51, 2001.
A. Bishop and P. Pathirana, "Localization of emitters via the intersection of bearing lines: A ghost elimination approach," *IEEE Transactions on Vehicular Technology*, vol. 56, No. 5, pp. 3106-3110, Sep. 2007.
A. Bishop and P. Pathirana, "A discussion on passive location discovery in emitter networks using angle-only measurements," *International Conference on Wireless Communications and Mobile Computing* (*IWCMC*), ACM, pp. 1337-1343, Jul. 2006.
J. Reed et al., "Multiple-source localization using line-of-bearing measurements: Approaches to the data association problem," *IEEE Military Communications Conference* (*MILCOM*), pp. 1-7, Nov. 2008.
A. Alexandridis et al., "Directional coding of audio using a circular microphone array," *IEEE International Conference on Acoustics, Speech and Signal Processing* (*ICASSP*), pp. 296-300, May 2013.
A. Alexandridis et al., "Capturing and Reproducing Spatial Audio Based on a Circular Microphone Array," *Journal of Electrical and Computer Engineering*, vol. 2013, Article ID 718574, pp. 1-16, 2013.
M. Taseska and E. Habets, "Spotforming using distributed microphone arrays," *IEEE Workshop on Applications of Signal Processing to Audio and Acoustics*, Oct. 2013.
S. Rickard and O. Yilmaz, "On the approximate w-disjoint orthogonality of speech," in *Proc. of ICASSP*, 2002, vol. 1, pp. 529-532.
N. Ito et al., "Designing the wiener post-filter for diffuse noise suppression using imaginary parts of inter-channel cross-spectra," in *Proc. of ICASSP*, 2010, pp. 2818-2821.
D. Pavlidi et al., "Real-time sound source localization and counting using a circular microphone array," *IEEE Trans. on Audio Speech, and Lang. Process*, vol. 21, No. 10, pp. 2193-2206, 2013.
L. Parra and C. Alvino, "Geometric source separation: merging convolutive source separation with geometric beamforming," *IEEE Transactions on Speech and Audio Processing*, vol. 10, No. 6, pp. 352-362, 2002.
V. Pulkki, "Virtual sound source positioning using vector based amplitude panning," *J. Audio Eng. Soc.*, vol. 45, No. 6, pp. 456-466, 1997.
J. Usher and J. Benesty, "Enhancement of spatial sound quality: A new reverberation-extraction audio upmixer," *IEEE Trans. on Audio Speech, and Lang. Process*, vol. 15, No. 7, pp. 2141-2150, 2007.
C. Faller and F. Baumgarte, "Binaural cue coding-part ii: Schemes and application," *IEEE Trans. on Speech and Audio Process*, vol. 11, No. 6, pp. 520-531, 2003.
M. Briand, et al., "Parametric representation of multichannel audio based on principal component analysis," in *AES 120$^{th}$ Conv.*, 2006.
M. Goodwin and J. Jot., "Primary-ambient signal decomposition and vector-based localization for spatial audio codding and enhancement," in *Proc. of ICASSP*, 2007, vol. 1, pp. 1-9.
J. He et al., "A study on the frequency-domain primary-ambient extraction for stereo audio signals," in *Proc. of ICASSP*, 2014, pp. 2892-2896.
J. He et al., "Linear estimation based primary-ambient extraction for stereo audio signals," *IEEE Trans. on Audio, Speech and Lang. Process.*, vol. 22, pp. 505-517, 2014.
C. Avendano and J. Jot, "A frequency domain approach to multichannel upmix," *J. Audio Eng. Soc*, vol. 52, No. 7/8, pp. 740-749, 2004.
O. Thiergart et al. "Diffuseness estimation with high temporal resolution via spatial coherence between virtual first-order microphones," in *Applications of Signal Processing to Audio and Acoustics* (*WASPAA*), 2011, pp. 217-220.
G. Carter et al, "Estimation of the magnitude-squared coherence function via overlapped fast fourier transform processing," *IEEE Trans. on Audio and Electroacoustics*, vol. 21, No. 4, pp. 337-344, 1973.
I. Santamaria and J. Via, "Estimation of the magnitude squared coherence spectrum based on reduced-rank canonical coordinates," in *Proc. of ICASSP*, 2007, vol. 3, pp. III-985.
D. Ramirez, J. Via and I. Santamaria, "A generalization of the magnitude squared coherence spectrum for more than two signals: definition, properties and estimation," in *Proc. of ICASSP*, 2008, pp. 3769-3772.
B. Cron and C. Sherman, "Spatial-correlation functions for various noise models," *J. Acoust. Soc. Amer.*, vol. 34, pp. 1732-1736, 1962.
H. Cox et al., "Robust adaptive beamforming," *IEEE Trans. on Acoust., Speech and Signal Process.*, vol. 35, pp. 1365-1376, 1987.

* cited by examiner

FOREGROUND SIGNAL SUPPRESSION APPARATUSES, METHODS, AND SYSTEMS

CROSS-REFERENCE TO RELATED APPLICATIONS

This application is a continuation of U.S. patent application Ser. No. 15/001,221, filed Jan. 19, 2016, which in turn claims priority to U.S. Provisional Patent Application No. 62/104,605, filed Jan. 16, 2015. This application is also a continuation-in-part of U.S. patent application Ser. No. 14/556,038, filed Nov. 28, 2014 (claiming priority to U.S. Provisional Patent Application No. 61/909,882, filed Nov. 27, 2013); which is in turn a continuation-in-part of U.S. patent application Ser. No. 14/294,095, filed Jun. 2, 2014 (claiming priority to U.S. Provisional Patent Application No. 61/829,760 filed May 31, 2013); which is in turn a continuation-in-part of U.S. patent application Ser. No. 14/038,726 filed Sep. 26, 2013 (claiming priority to U.S. Provisional Patent Application No. 61/706,073 filed Sep. 26, 2012). This application is also related to U.S. patent application Ser. No. 15/001,190 and U.S. patent application Ser. No. 15/001,211, both of which were filed on Jan. 19, 2016. Each of the applications listed in this paragraph are expressly incorporated by reference herein in their entirety.

FIELD

The present subject matter is directed generally to apparatuses, methods, and systems for capturing and reproducing acoustic environments, and more particularly, to FOREGROUND SIGNAL SUPPRESSION APPARATUSES, METHODS, AND SYSTEMS (hereinafter Foreground Suppressor).

BACKGROUND

In most cases sensor arrays and spatial filtering aim to enhance individual sources by suppressing ambient noise and reverberation. However, the opposite approach, that of suppressing individual sources in favor of the ambient sound, and of the whole acoustic scene in general, may also be useful. For example, emerging demand in satellite and online-based sports event broadcasting to deliver an immersive experience to the home-user, potentially by giving users the ability to select the audiovisual content of their choice from a given list of options.

SUMMARY

A processor-implemented method for foreground signal suppression is disclosed. The method includes: capturing a plurality of input signals using a plurality of sensors within a sound field; subjecting each input signal to a short-time Fourier transform to transform each signal into a plurality of non-overlapping subband regions; estimating the diffuseness of the sound field based on the plurality of input signals; decomposing each of the plurality of input signals into a diffuse component and a directional component based on the diffuseness estimate; applying a spatial analysis operation to filter the directional component of each of the plurality of input signals, wherein the spatial analysis operation includes applying a set of beamformers to the directional components to produce a plurality of beamformer signals; and processing the plurality of beamformer signals to produce a foreground channel for each of the plurality of sensors.

A system for foreground signal suppression is also disclosed. The system includes: a plurality of sensors configured to capture a plurality of input signals within a sound field; a processor interfacing with the plurality of sensors and configured to receive the plurality of input signals; an STFT module interfacing with the processor and configured to apply a short-time Fourier transform to transform each signal into a plurality of non-overlapping subband regions; a diffuseness estimator interfacing with the processor and configured to estimate the diffuseness of the sound field based on the plurality of input signals; a signal decomposer interfacing with the processor and configured to decompose each of the plurality of input signals into a diffuse component and a directional component based on the diffuseness estimate; a spatial analyzer interfacing with the processor and configured to apply a spatial analysis operation to filter the directional component of each of the plurality of input signals, wherein the spatial analysis operation includes applying a set of beamformers to the directional components to produce a plurality of beamformer signals; and a beamformer processor module configured to process the plurality of beamformer signals to produce a foreground channel for each of the plurality of sensors.

A processor-readable tangible medium for foreground signal suppression is disclosed. The medium stores processor-issuable-and-generated instructions to: capture a plurality of input signals using a plurality of sensors within a sound field; subject each input signal to a short-time Fourier transform to transform each signal into a plurality of non-overlapping subband regions; estimate the diffuseness of the sound field based on the plurality of input signals; decompose each of the plurality of input signals into a diffuse component and a directional component based on the diffuseness estimate; apply a spatial analysis operation to filter the directional component of each of the plurality of input signals, wherein the spatial analysis operation includes applying a set of beamformers to the directional components to produce a plurality of beamformer signals; process the plurality of beamformer signals to produce a foreground channel for each of the plurality of sensors; orthogonalize each of the input signals with respect to the foreground channels to produce a background signal for each of the plurality of sensors; and apply spatial filtering to each of the background signals to produce filtered signals and transmitting the filtered signals to an output device configured to reproduce the background scene of the sound field.

BRIEF DESCRIPTION OF THE DRAWINGS

The accompanying drawings illustrate various non-limiting, example, inventive aspects of the Foreground Suppressor.

DETAILED DESCRIPTION

Foreground Suppressor

Figure 1:
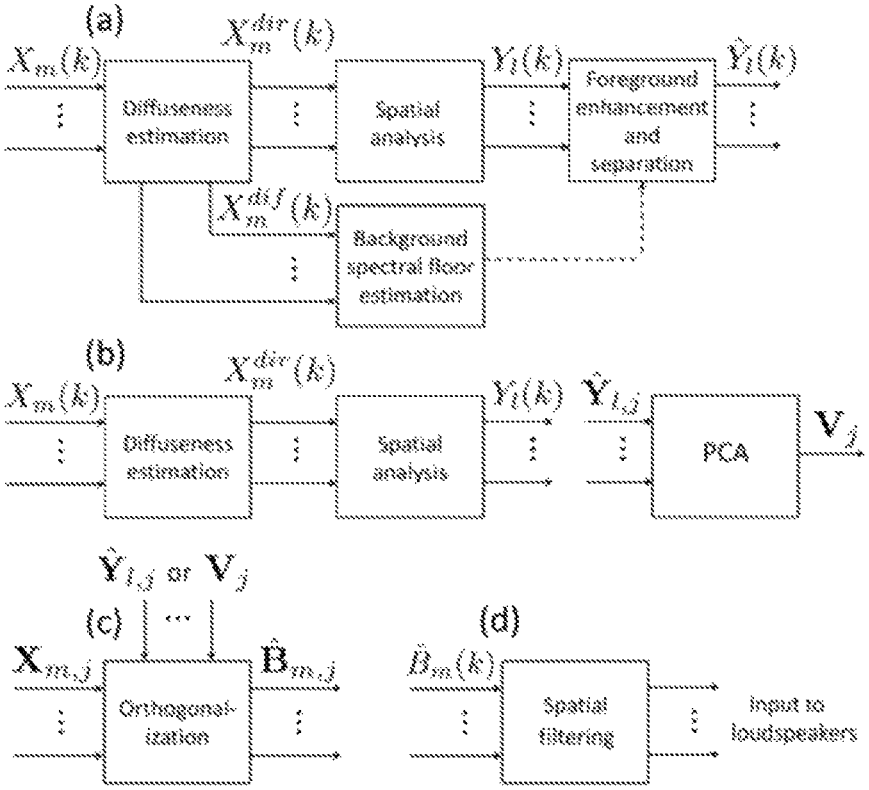
FIG. 1 is a schematic diagram showing exemplary methods used by the Foreground Suppressor based on W-Disjoint Orthoganality (WDO) in (a), and based on Principal Component Analysis (PCA) in (b); the orthogonalization process is shown in (c); and a spatial filtering process is shown in (d)

FOREGROUND SIGNAL SUPPRESSION APPARATUSES, METHODS, AND SYSTEMS (hereinafter Foreground Suppressor) are disclosed in this specification, which describes a novel approach for decomposing an observed sound field, when the ambient or background sound is the only important information to be captured and transmitted to the listener. The Foreground Suppressor may use a compact circular sensor array embedded in a crowded ambient acoustic environment and that is prone to interference from directional speech originating from multiple nearby speakers. The Foreground Suppressor is able to suppress the undesired components in a manner that is superior to established approaches in spatial audio processing, namely, direct-to-diffuse decomposition and Primary-Ambient Extraction (PAE).

Several applications related to audio processing benefit from decomposing the information in the audio channels into a directional and a diffuse component. Estimation of the diffuseness of the sound field is useful, for example, to manipulate and reproduce spatial sound, to enhance speech by suppressing ambient noise, and to extract and enhance reverberation. In spatial audio, it is becoming a common practice to render point-like directional sources and ambient sound differently. This allows for flexible parameterization of the spatial information, which in turn can be exploited for reducing data rate and for alleviating compatibility problems between different reproduction systems.

Techniques for decomposing the sound field often rely on subspace methods or on the Magnitude Squared Coherence (MSC). Techniques belonging in the first family are usually exploited in Primary-Ambient Extraction (PAE). PAE is used for the analysis and extraction of the audio content in stereo recordings, usually with the purpose of delivering it to a playback system which employs a higher number of reproduction channels. While the mixing conditions in the stereo channels are generally unknown, the main assumption in PAE is that the directional (primary) components in the mix are dominant over the diffuse (ambient) components and that they are coherent within the audio channels. On the other hand, MSC can be used for estimating the diffuseness of the sound field.

A comparison of the novel method used by the Foreground Suppressor with other methods for decomposing an observed sound field, considering that the ambient or background sound is the only important information that needs to be captured and transmitted to the listener, will be presented by considering a compact circular sensor array which is embedded in a crowded acoustic environment and is at the same time subject to interference from multiple nearby speakers. This is a typical scenario which may occur in the capturing and broadcasting of the sound scene in the case of an athletic event. It would be desirable, for example, to create a panoramic image of the spectators responses during the game without the inevitable masking that the ones in the foreground may cause to the overall acoustic scene. This specification describes an embodiment of the signal model used by the Foreground Suppressor and illustrates how simple direct-to-diffuse decomposition can be exploited for the purposes of this task. This specification also proposes a novel approach for improving foreground suppression, as opposed to a classical subspace method which is dictated by treating the problem, as in PAE.

In one exemplary embodiment, the Foreground Suppressor distinguish the sound scene into two basic components which are assumed to be jointly uncorrelated; the foreground scene, which may comprise a small number of directional sources (the foreground sources) at discrete locations in the vicinity of the sensor array, and the background scene, which may include the ambient sound as well as the direct path from all the remaining sources that are farther away.

In one exemplary embodiment, the Foreground Suppressor implements an analysis in the short-time frequency domain. Let $X_m(k,i)$ be the signal recorded at the math sensor at time frame i and discrete frequency k. The Foreground Suppressor can express the signal as a superposition of a foreground and a background component, $F_m(k,i)$ and $B_m(k,i)$ respectively. By omitting the time-frame index i from now on and by assuming low microphone noise, the equation can be written as follows:

$$X_m(k)=F_m(k)+B_m(k),\ m=1,\ldots M, \tag{1}$$

where M is the number of sensors.

The Foreground Suppressor may also consider an extension of the same signal model in the subband domain, which is based on grouping of the frequency bins into multiple partitions.

In particular, the Foreground Suppressor may consider a non-uniform partitioning of J=20 non-overlapping subband regions with corners defined by the frequency indexes $\{1, b_2, \ldots, b_J, N_{FFT}/2+1\}$, where $N_{FFT}$ is the Short Time Fourier Transform (STFT) length. In one exemplary embodiment, the partitioning is be based on the Equivalent Rectangular Bandwidth (ERB) and the width of each frequency-subband is approximately 2 ERB. The jth subband region of the mth microphone signal may then be defined as $X_{m,j}=[X_m(b_j), \ldots, X_m(b_{j+1}-1)]^T$ and letting $F_{m,j}$, $B_{m,j}$ be accordingly constructed, the previous model may be also written as $$X_{m,j}=F_{m,j}+B_{m,j},\ m=1,\ldots,M. \tag{2}$$

In one exemplary embodiment, the diffuseness of a sound field can be estimated with practical microphone setups based on the Magnitude Squared Coherence (MSC) between two microphone signals $X_m(k)$ and $X_n(k)$ as $$C_{mn}(k)=\frac{|E\{X_m(k)X_n(k)^*\}|^2}{E\{|X_m(k)|^2\}E\{|X_n(k)|^2\}}, \tag{3}$$

where $(\cdot)^*$ denotes complex conjugation and $E\{\cdot\}$ denotes the expectation operator. The minimum of this function is obtained for purely diffuse sound field (close to 0) and the maximum for only direct sound (close to 1). However, when using a compact sensor array, the correlation of the microphone signals at the low frequencies is high, leading to values of MSC close to 1, even if the sound field is purely diffuse. One way to avoid such a biased estimation is to define a diffuseness estimator by scaling the measured MSC with respect to a theoretical estimation of diffuse noise coherence. This estimation represents the theoretical value of the coherence, which, given a particular noise model, would be measured with the actual array geometry and microphone type. For example, assuming spherical isotropic noise and an array of M omnidirectional sensors, the M×M noise coherence matrix $\Gamma(k)$ can be modelled as $$\Gamma_{mn}(k) = \frac{\sin(2\pi f_k d_{mn}/c)}{2\pi f_k d_{mn}/c}, \quad (4)$$

where c is the speed of sound, $f_k$ is the frequency in Hertz corresponding to the k-th frequency index and $d_{mn}$ is the distance between sensors m and n.

An estimation of diffuseness Ψ(k) at frequency bin k may then be derived as $$\Psi(k) = \frac{1 - C_{mn}(k)}{1 - \Gamma_{mn}^2(k)}. \quad (5)$$

The diffuseness estimator in Eq. 5 represents a linear scaling of the measured MSC to the range [0,1] such that Ψ(k)=1 in purely diffuse fields and Ψ(k)=0 in non-diffuse fields. It should be noted that the estimated diffuseness value may exceed the theoretical maximum value of 1 when $C_{mn}(k)$ becomes smaller than the assumed minimum $\Gamma_{ij}(k)^2$. In the exemplary embodiments described in this specification, the values of Ψ(k) greater than one are treated as 1.

In one exemplary embodiment, by assuming that the directional and the diffuse component are mutually uncorrelated, the Foreground Suppressor can decompose the sound pressure $X_m(k)$ at any sensor into a directional and a diffuse component as $$X_m^{dir}(k) = \sqrt{1-\Psi(k)}X_m(k) \quad (6)$$

$$X_m^{dif}(k) = \sqrt{\Psi(k)}X_m(k) \quad (7)$$

where superscripts dir and dif refer to the directional and diffuse components, respectively. This signal decomposition approach can be applied to the problem of foreground suppression, since it is expected that the foreground sound sources will have a dominant direct path and therefore they will be present in $X_m^{dir}(k)$, but absent from $X_m^{dif}(k)$. The diffuse signal component $X_m^{dif}(k)$ may thus be seen as a first solution to the foreground-suppression problem.

As can be seen from the equations above, the directional and the diffuse component have different amplitudes but equal phases. In practice, this results in $X_m^{dif}(k)$ being correlated to $X_m^{dir}(k)$, which in turn results in the foreground components being still audible in the diffuse channel. The Foreground Suppressor can be configure to alleviate this problem. Two exemplary approaches will be presented in this specification, although other approaches are also possible. In one embodiment, the Foreground Suppressor derives an estimation of the foreground signal by exploiting the diffuse-to-direct decomposition and then uses this estimation to remove the foreground components from each microphone signal independently. An important advantage of this approach is that ideally, it will leave the phase and amplitude of the background signal at each microphone unaffected. As a result, any type of spatial filtering technique (e.g. beamforming) may be used for spatial rendering of the background acoustic scene.

Following the direct-to-diffuse decomposition, the Foreground Suppressor may be configured to apply a spatial analysis stage by considering a set of fixed filter-sum super-directive beamformers which filter the directional signals $X_m^{dir}(k)$ in order to capture the foreground scene.

In one exemplary embodiment, in each time frame i, the beamforming process employs L concurrent beamformers whose look directions are uniformly distributed over the azimuth plane at angles $\theta_l$=360(l−1)/l in degrees. In one embodiment, each beamformer steers its beam in one fixed direction yielding in total L signals $$Y_l(k) = \sum_{m=1}^{M} w_m^*(k, \theta_l) X_m^{dir}(k),$$

l=1, . . . , L in the frequency domain. A variety of approaches can be used for optimizing the beamformer weights $w_m(k, \theta_l)$. For example, the Foreground Suppressor may choose beamformers that maximize the array gain under the assumption of a spherically isotropic noise field as $$w(k, \theta_l) = \frac{[\epsilon I + \Gamma(k)]^{-1} d(k, \theta_s)}{d(k, \theta_s)^H [\epsilon I + \Gamma(k)]^{-1} d(k, \theta_s)}, \quad (8)$$

where ϵ is a positive scalar used to satisfy the white noise gain constrain, the M×M matrix Γ(k) is defined in Eq. (4), $w(k,\theta_l)=[w_1(k,\theta_l), \ldots, w_M(k,\theta_l)]^T$ is the vector with the beamformer weights and $d(k,\theta_l)=[e^{-j2\pi f_k \tau_1(\theta_l)}, \ldots, e^{-j2\pi f_k \tau_M(\theta_l)}]^T$ is the row vector of phase shifts to align the sensor outputs for a signal from direction $\theta_l$ for the specific array geometry. These beamformers are characterized by unity signal response and zero phase shift.

In one exemplary embodiment, the Foreground Suppressor subjects the beamformer outputs $Y_l(k)$ to further processing, which results in separation of the foreground sources according the their spatial locations. This approach is based on the assumption of W-Disjoint Orthogonality (WDO), which is a valid assumption for signals with a sparse time-frequency representation such as speech. In one exemplary embodiment, the Foreground Suppressor assumes that, at each time-frequency element, there is only one dominant foreground sound source and that it is unlikely that two or more foreground speakers will carry significant energy in the same time-frequency element. The WDO assumption may be imposed in the foreground channels (k) through the process $$\tilde{Y}_l(k) = \begin{cases} Y_l(k), & \text{if } |Y_l(k)| > |Y_{l'}(k)|, \forall\, l \neq l'; \\ 0, & \text{otherwise} \end{cases} \quad (9)$$

Eq. (9) implies that for each frequency element, only the corresponding element from one of the beamformer signals is retained, that is, the signal with the highest energy with respect to the other signals at that frequency bin. As a consequence, the resulting separated foreground channels have disjoint support and are therefore orthogonal to one another, i.e., $\tilde{Y}_l(k)\tilde{Y}_{l'}(k)=0$, if l≠l'.

In one exemplary embodiment, the foreground channels may then be subject to an enhancement approach which aims at discarding frequency components whose energy is lower than a specified threshold. This threshold may be based on an estimation of the background spectral floor, which may in turn be defined by using the diffuse component in the microphone signals $X_m^{dif}(k)$. In one exemplary embodiment, rather than calculating the background spectral floor separately at each frequency bin, the background spectral floor is averaged over all frequency bins in the same subband region, forming J spectral floor estimations $$p_{k\in U_j} = p_j = \sqrt{\frac{1}{b_{j+1}-b_j}\sum_{k\in U_j}|X_1(k)|^2}\ ,\ j=1,\ldots,J. \tag{10}$$

In one embodiment, because of the small distance between the sensors, the Foreground Suppressor assumes that the auto spectral densities of the sensors vary trivially from one sensor to the other and so arbitrarily chooses the index of the first sensor.

The separated foreground channels $\tilde{Y}_l(k)$ may thus be further modified as follows $$\hat{Y}_l(k) = \begin{cases} \tilde{Y}_l(k), & \text{if } |\tilde{Y}_l(k)| > \mu p_j, \\ 0, & \text{otherwise} \end{cases} \tag{11}$$

where $\mu>0$ is a free scaling parameter and j is the index of the subband region containing the kth frequency bin. Following this step, the resulting time-frequency foreground channels become sparser, in comparison with previous stage, and the sparsity is dependent on the value of $\mu$.

For this approach, orthogonalization of the microphone signals with respect to the foreground channels $\hat{Y}_l(k)$ is the final step, which completes the process. First, the frequency-domain microphone signals and foreground channels are partitioned into the J subbands by grouping of the FFT bins. Due to the orthogonality in the foreground channels, the process may be accomplished independently for each channel, avoiding thus the use of matrix inversion. The procedure, which is repeated for all microphone signals, may be written for the mth microphone signal as $$\hat{B}_{m,j} = X_{m,j} - \sum_{l=1}^{L}\hat{Y}_{l,j}c_{mjl}, \tag{12}$$

with complex coefficient $c_{mjl}$ resulting from simple orthogonal projection as $$c_{mjl} = \frac{\hat{Y}_{l,j}^H X_{m,j}}{\|\hat{Y}_{l,j}\|_2^2}. \tag{13}$$

The signals $\hat{B}_{m,j}$ are the final output of the process, representing an estimation of the background components at each subband region and microphone. In contrast to direct-to-diffuse decomposition, here $\hat{B}_{m,j}$ is orthogonal to the estimated foreground component $$\hat{F}_{m,j} = \sum_{l=1}^{L}\hat{Y}_{l,j}c_{mjl}.$$

The particular approach that may be used by the Foreground Suppressor can be termed W-disjoint Orthogonality based Foreground Suppression (WDO-FS), which is illustrated in FIG. 1(*a*) and FIG. 1(*c*).

In one exemplary embodiment, the Foreground Suppressor may use Principal Component Analysis (PCA), which may be used to extract the primary component from multi-channel audio. Use of PCA relies on the assumption that the primary components are dominant over the ambient components and furthermore, coherent within the audio channels, and that these components will therefore emerge by performing some sort of eigenanalysis and by looking into the principle eigenvectors. In one exemplary embodiment, the Foreground Suppressor applies PCA to the foreground suppression problem by performing PCA on the output of the spatial analysis stage as described below.

First, the Foreground Suppressor takes the beamformer outputs at the jth subband region after the spatial analysis step stacked in the single matrix, as described by $$Y_j=[Y_{1,j}\ Y_{2,j}\ldots Y_{L,j}]. \tag{14}$$

The Foreground Suppressor then takes the eigenvector $V_j$ corresponding to the largest eigenvalue of the covariance matrix, $R=Y_jY_j^H$ which contains a unit norm version of the primary component. The Foreground Suppressor may then orthagonalize the microphone signals with respect to $V_j$ as $$\hat{B}_{m,j}=X_{m,j}-V_jc_{mj},\ m=1,\ldots,M, \tag{15}$$

where now $c_{mj}=V_j^HX_{m,j}$. The signals $\hat{B}_{m,j}$, m=1, . . . , M are the final output of the process, representing an estimation of the background component at each microphone. The complete process is named PCA based Foreground Suppression (PCA-FS) and is shown schematically in FIG. 1(*a*) and FIG. 1(*c*)

Experimental results have verified the superiority of the methods and systems used by the Foreground Suppressor. In one experiment, recordings were produced with a uniform circular array of four omnidirectional microphones of radius R=0.02 m. The recordings constituting the background scene took place in a large reverberant basketball court, during the graduation ceremony of the University of Crete. Both the number of spectators as well as the size of the enclosure were ideal in terms of what can be defined as an "ambient" sound field. There were many people talking, cheering and applauding simultaneously, while their distance from the sensors was above seven meters in most of the cases. Additional microphone signals were simulated by convolving speech signals with the acoustic transfer function corresponding to four speakers located a small distance away and at different angles from the array. The exact locations of the individual speakers with respect to the center of the sensor array were at (−0.34, 0.94, 0.20), (0.92, 0.92, 0.23), (0.63, −1.36, 0.30) and (−0.15, −1.69, 0.30) m.

During the experiment, the Foreground Suppressor used a mixing procedure in order to superimpose the speech signals onto the signals recorded in the basketball court as follows, $$x_m(n)=b_m(n)+af_m(n), \tag{16}$$

$$x_m=b_m+af_m, \tag{17}$$

where $b_m(n)$ and $f_m(n)$ are the time-domain signals at the mth microphone for the real and the synthetic recordings respectively, $b_m$ and $f_m$ are the corresponding column vectors by aggregating all samples together and a is a scalar used for varying the balance in the mix. The experiment was conducted to consider $b_m$ and $f_m$, as the background and the foreground component respectively. Although $b_m$ may inevitably contain some directional components, the nature of these recordings is sufficiently different to support the purpose of the experiment.

To quantify the performance of foreground suppression, the Foreground to Background Ratio (FBR) was defined in the time domain, $$\text{FBR}=20\log_{10}(\|af_1\|_2/\|b_1\|_2), \tag{18}$$

which can be measured directly at the input stage since both $b_m$ and $af_m$ are known. FBR may be measured also in the time-domain output signal of each algorithm, using zero lag cross-correlations. In particular, the FBR may be calculated as the ratio of the energy in the output signal which is parallel to $f_1$ to the energy which is parallel to $b_1$. An additional criterion examined is the Background Attenuation (BA), which expresses the amount of energy subtracted from the background signal and can be measured at the output signal of each algorithm in a similar manner.

The conditions for the experiment were as follows; the overlap-add method with an FFT size of 4096 samples, a frame overlap of 50% and a sampling frequency of 44.1 kHz was used. The spatial analysis stage consisted of L=8 beamformers uniformly distributed at the azimuth plane and the WDO-FS scaling parameter μ was set to 1.5. For the computation of the cross-correlations required in Eq. (3) a casual recursive formula with a forgetting factor value of 0.35 was used. At each time frame and frequency, the MSC values were calculated for both opposite microphone pairs and the greatest of these two values was used for the calculation of the diffuseness.

Figure 2:
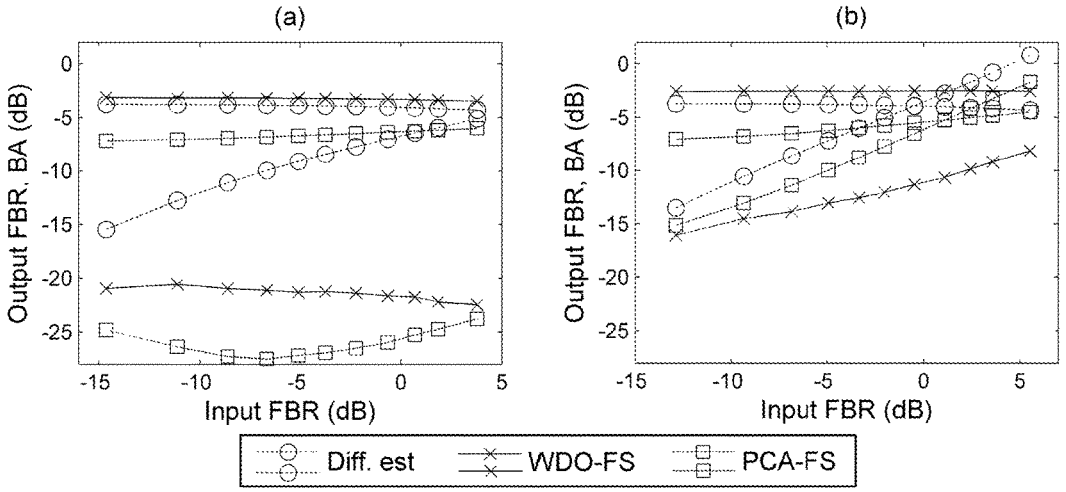
FIG. 2 is a plot of output Foreground-to-Background Ration (FBR) and Background Attenuation (BA) as a function of the input FRB for two foreground speakers (a) and four foreground speakers (b) when using various embodiments of the Foreground Suppressor.

Results are presented for 15 seconds of audio duration by plotting the variation of output FBR and BA at the output of each method as a function of the input FBR in FIG. 2. Results are shown for only two speakers active in (a) and for all four speakers in (b). It can be seen that the suppression performance degrades for all techniques when the number of foreground speakers increases, whereas BA is more or less the same. In the case of four speakers, WDO-FS has by far the best suppression performance. Interestingly, the same method also exhibits the least BA values. As expected, simple use of the estimated diffuse component has the weakest performance in terms of suppression among all three techniques. Also, PCA-FS performs better than the latter in terms of suppression, but it produces high attenuation values, meaning that important information from the background is lost.

Figure 3:
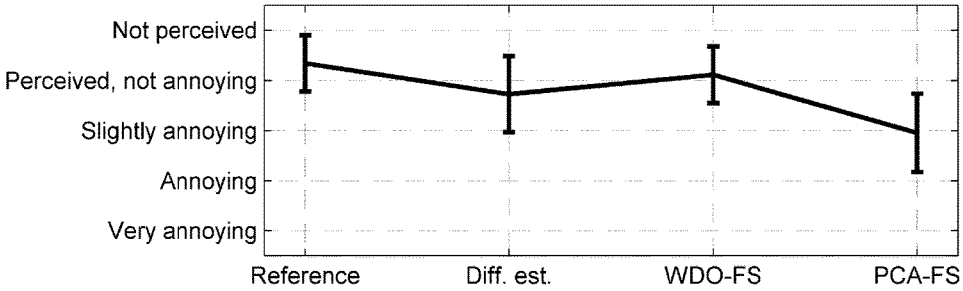
FIG. 3 is a plot of the perceived quality of extracted background sound when using various embodiments of the Foreground Suppressor.

Listening tests were also conducted in order to evaluate the methods used by the Foreground Suppressor. Eleven subjects were asked to judge the sound quality of the output signal with the four speakers in comparison to a reference signal for values of input FBR of −6, −3, 0 and 3 dB. The reference signal was the original signal recorded at the first microphone plus a weighted version of the foreground signal, so that the FBR in the reference signal matches the output FBR of each algorithm. This was done to ensure that the listeners judged the sound quality of each audio file and not the content. The participants were given a five-scale grading system, with 1 being "very annoying" difference compared to the reference and 5 being "not perceived" difference from the reference. The mean scores across all subjects and 95% confidence intervals are shown in FIG. 3. It can be seen that WDO-FS and PCA-FS have the best and worst scores respectively, which follows their respective BA values depicted in FIG. 2. The rapid variation of the projection coefficients at each time frame in Eqs. (12) and (15) acts as a source of distortion for WDO-FS and PCA-FS, but as the results of the listening test indicate, at reasonable FBR values, this is not perceived at an annoying level for WDO-FS.

When it comes to capturing and reproduction of crowded acoustic environments, it would be advantageous to suppress sources in the foreground in order to improve the end-user's experience of the overall acoustic event. Although not originally intended for this purpose, diffuseness estimation techniques and PAE may be seen as two existing approaches for addressing the problem. By modifying PAE in novel way to operate on a compact sensor array, the Foreground Suppressor provides better suppression performance than was previously possibly using PAE. In addition, the WDO-FS approach that may also be used by the Foreground Suppressor is more robust to the number of foreground sources and also achieves the best subjective score in terms of sound quality.

Foreground Suppressor Controller

Figure 4:
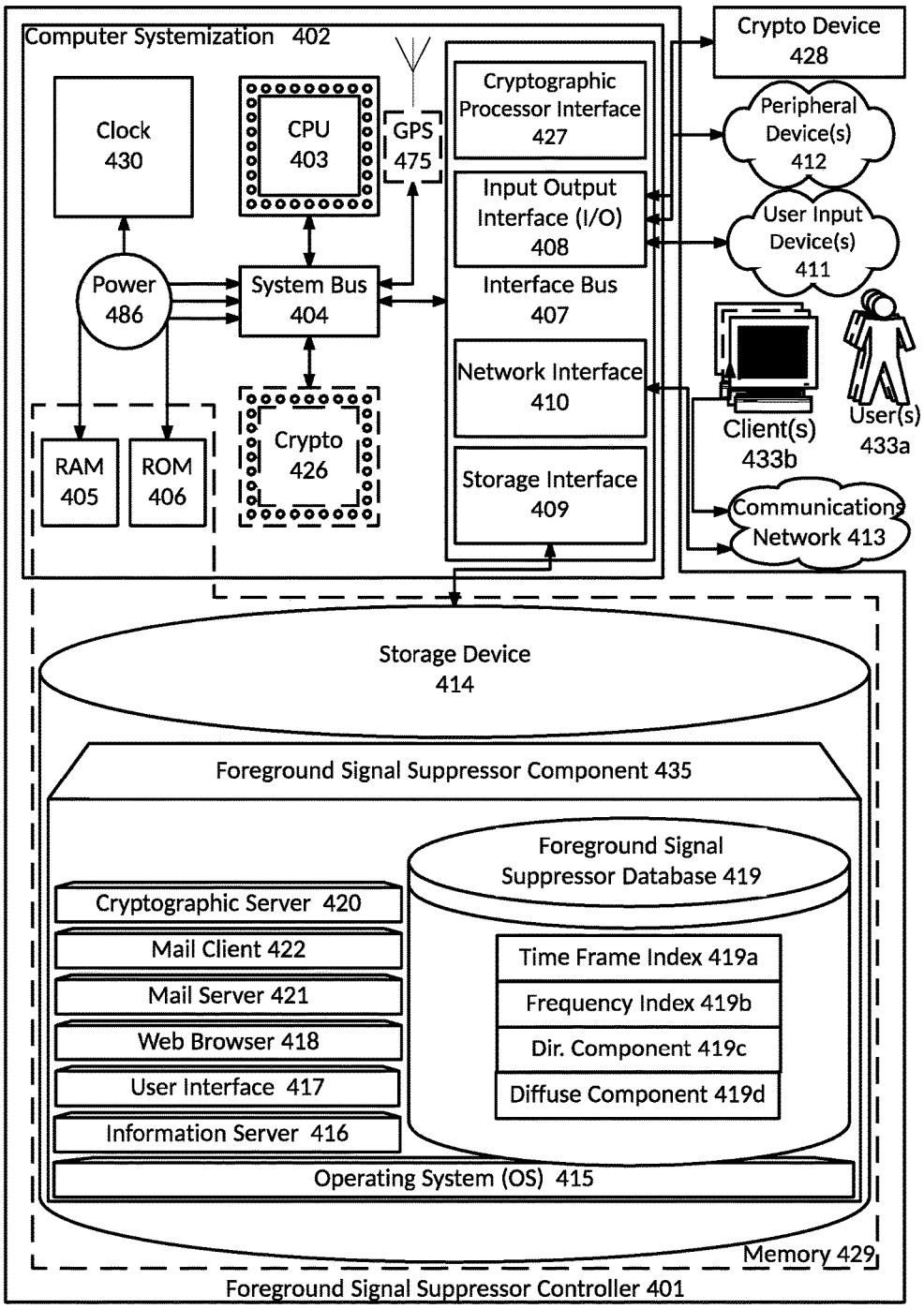
FIG. 4 is a block diagram illustrating exemplary embodiments of a Foreground Suppressor controller.

FIG. 4 illustrates inventive aspects of an Foreground Suppressor controller 401 in a block diagram. In this embodiment, the Foreground Suppressor controller 401 may serve to provide foreground signal suppression.

Typically, users, which may be people and/or other systems, may engage information technology systems (e.g., computers) to facilitate information processing. In turn, computers employ processors to process information; such processors 403 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 429 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the Foreground Suppressor controller 401 may be connected to and/or communicate with entities such as, but not limited to: one or more users from user input devices 411; peripheral devices 412; an optional cryptographic processor device 428; and/or a communications network 413.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The Foreground Suppressor controller 401 may be based on computer systems that may comprise, but are not limited to, components such as: a computer systemization 402 connected to memory 429.

Computer Systemization

A computer systemization 402 may comprise a clock 430, central processing unit ("CPU(s)" and/or "processor(s)" (these terms are used interchangeable throughout the disclosure unless noted to the contrary)) 403, a memory 429 (e.g., a read only memory (ROM) 406, a random access memory (RAM) 405, etc.), and/or an interface bus 407, and most frequently, although not necessarily, are all interconnected and/or communicating through a system bus 404 on one or more (mother)board(s) 402 having conductive and/or otherwise transportive circuit pathways through which instructions (e.g., binary encoded signals) may travel to effect communications, operations, storage, etc. Optionally, the computer systemization may be connected to an internal power source 486. Optionally, a cryptographic processor 426 may be connected to the system bus. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 429 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the Foreground Suppressor controller and beyond through various interfaces. Should processing requirements dictate a greater amount speed and/or capacity, distributed processors (e.g., Distributed Foreground Suppressor), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the Foreground Suppressor may be achieved by implementing a microcontroller such as CAST's R8051XC2 microcontroller; Intel's MCS 51 (i.e., 8051 microcontroller); and/or the like. Also, to implement certain features of the Foreground Suppressor, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the Foreground Suppressor component collection (distributed or otherwise) and/or features may be implemented via the microprocessor and/or via embedded components; e.g., via ASIC, coprocessor, DSP, FPGA, and/or the like. Alternately, some implementations of the Foreground Suppressor may be implemented with embedded components that are configured and used to achieve a variety of features or signal processing.

Depending on the particular implementation, the embedded components may include software solutions, hardware solutions, and/or some combination of both hardware/software solutions. For example, Foreground Suppressor features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the Foreground Suppressor features. A hierarchy of programmable interconnects allow logic blocks to be interconnected as needed by the Foreground Suppressor system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the Foreground Suppressor may be developed on regular FPGAs and then migrated into a fixed version that more resembles ASIC implementations. Alternate or coordinating implementations may migrate Foreground Suppressor controller features to a final ASIC instead of or in addition to FPGAs. Depending on the implementation all of the aforementioned embedded components and microprocessors may be considered the "CPU" and/or "processor" for the Foreground Suppressor.

Power Source

The power source 486 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 486 is connected to at least one of the interconnected subsequent components of the Foreground Suppressor thereby providing an electric current to all subsequent components. In one example, the power source 486 is connected to the system bus component 404. In an alternative embodiment, an outside power source 486 is provided through a connection across the I/O 408 interface. For example, a USB and/or IEEE 1394 connection carries both data and power across the connection and is therefore a suitable source of power.

Interface Adapters

Interface bus(ses) 407 may accept, connect, and/or communicate to a number of interface adapters, conventionally although not necessarily in the form of adapter cards, such as but not limited to: input output interfaces (I/O) 408, storage interfaces 409, network interfaces 410, and/or the like. Optionally, cryptographic processor interfaces 427 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 409 may accept, communicate, and/or connect to a number of storage devices such as, but not limited to: storage devices 414, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 410 may accept, communicate, and/or connect to a communications network 413. Through a communications network 413, the Foreground Suppressor controller is accessible through remote clients 433*b* (e.g., computers with web browsers) by users 433*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed Foreground Suppressor), architectures may similarly be employed to pool, load balance, and/or otherwise increase the communicative bandwidth required by the Foreground Suppressor controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 410 may be used to engage with various communications network types 413. For example, multiple network interfaces may be employed to allow for the communication over broadcast, multicast, and/or unicast networks.

Input Output interfaces (I/O) 408 may accept, communicate, and/or connect to user input devices 411, peripheral devices 412, cryptographic processor devices 428, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless: 802.11a/b/g/n/x, Bluetooth, code division multiple access (CDMA), global system for mobile communications (GSM), WiMax, etc.; and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 411 may be card readers, dongles, finger print readers, gloves, graphics tablets, joysticks, keyboards, mouse (mice), remote controls, retina readers, trackballs, trackpads, and/or the like.

Peripheral devices 412 may be connected and/or communicate to I/O and/or other facilities of the like such as network interfaces, storage interfaces, and/or the like. Peripheral devices may be audio devices, cameras, dongles (e.g., for copy protection, ensuring secure transactions with a digital signature, and/or the like), external processors (for added functionality), goggles, microphones, monitors, network interfaces, printers, scanners, storage devices, video devices, video sources, visors, and/or the like.

It should be noted that although user input devices and peripheral devices may be employed, the Foreground Suppressor controller may be embodied as an embedded, dedicated, and/or monitor-less (i.e., headless) device, wherein access would be provided over a network interface connection.

Cryptographic units such as, but not limited to, microcontrollers, processors 426, interfaces 427, and/or devices 428 may be attached, and/or communicate with the Foreground Suppressor controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 429. However, memory is a fungible technology and resource, thus, any number of memory embodiments may be employed in lieu of or in concert with one another. It is to be understood that the Foreground Suppressor controller and/or a computer systemization may employ various forms of memory 429. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 429 will include ROM 406, RAM 405, and a storage device 414. A storage device 414 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 429 may contain a collection of program and/or database components and/or data such as, but not limited to: operating system component(s) 415 (operating system); information server component(s) 416 (information server); user interface component(s) 417 (user interface); Web browser component(s) 418 (Web browser); Foreground Suppressor database(s) 419; mail server component(s) 421; mail client component(s) 422; cryptographic server component(s) 420 (cryptographic server); the Foreground Suppressor component(s) 435; and/or the like (i.e., collectively a component collection). These components may be stored and accessed from the storage devices and/or from storage devices accessible through an interface bus. Although non-conventional program components such as those in the component collection, typically, are stored in a local storage device 414, they may also be loaded and/or stored in memory such as: peripheral devices, RAM, remote storage facilities through a communications network, ROM, various forms of memory, and/or the like.

Operating System

The operating system component 415 is an executable program component facilitating the operation of the Foreground Suppressor controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the Foreground Suppressor controller to communicate with other entities through a communications network 413. Various communication protocols may be used by the Foreground Suppressor controller as a subcarrier transport mechanism for interaction, such as, but not limited to: multicast, TCP/IP, UDP, unicast, and/or the like.

Information Server

An information server component 416 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective–) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the Foreground Suppressor controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the Foreground Suppressor database 419, operating systems, other program components, user interfaces, Web browsers, and/or the like.

Access to the Foreground Suppressor database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the Foreground Suppressor. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the Foreground Suppressor as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 417 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 418 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the Foreground Suppressor enabled nodes. The combined application may be nugatory on systems employing standard Web browsers.

Mail Server

A mail server component 421 is a stored program component that is executed by a CPU 403. The mail server may be a conventional Internet mail server such as, but not limited to sendmail, Microsoft Exchange, and/or the like. The mail server may allow for the execution of program components through facilities such as ASP, ActiveX, (ANSI) (Objective–) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the Foreground Suppressor.

Access to the Foreground Suppressor mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component is a stored program component that is executed by a CPU 403. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component is a stored program component that is executed by a CPU 403, cryptographic processor 426, cryptographic processor interface 427, cryptographic processor device 428, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the Foreground Suppressor may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the Foreground Suppressor component to engage in secure transactions if so desired. The cryptographic component facilitates the secure accessing of resources on the Foreground Suppressor and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The Foreground Suppressor Database

The Foreground Suppressor database component 419 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the Foreground Suppressor database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the Foreground Suppressor database is implemented as a data-structure, the use of the Foreground Suppressor database 419 may be integrated into another component such as the Foreground Suppressor component 435. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 419 includes several tables 419*a-e*, including a time_frame_index table 419*a*, a frequency_index table 419*b*, a directional_component table 419*c*, and a diffuse_component table 419*d*.

In one embodiment, the Foreground Suppressor database may interact with other database systems. For example, employing a distributed database system, queries and data access by search Foreground Suppressor component may treat the combination of the Foreground Suppressor database, an integrated data security layer database as a single database entity.

In one embodiment, user programs may contain various user interface primitives, which may serve to update the Foreground Suppressor. Also, various accounts may require custom database tables depending upon the environments and the types of clients the Foreground Suppressor may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 419*a-d*. The Foreground Suppressor may be configured to keep track of various settings, inputs, and parameters via database controllers.

The Foreground Suppressor database may communicate to and/or with other components in a component collection, including itself, and/or facilities of the like. Most frequently, the Foreground Suppressor database communicates with the Foreground Suppressor component, other program components, and/or the like. The database may contain, retain, and provide information regarding other nodes and data.

The Foreground Suppressors

The Foreground Suppressor component 435 is a stored program component that is executed by a CPU. In one embodiment, the Foreground Suppressor component incorporates any and/or all combinations of the aspects of the Foreground Suppressor that was discussed in the previous figures. As such, the Foreground Suppressor affects accessing, obtaining and the provision of information, services, transactions, and/or the like across various communications networks.

The Foreground Suppressor component enables the determination of weights for constituents of index-linked financial portfolios, the acquisition and/or maintenance/management of those constituents, the determination of market values and/or returns associated with the indices, the generation of financial products based on the indices, and/or the like and use of the Foreground Suppressor.

The Foreground Suppressor component enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the Foreground Suppressor server employs a cryptographic server to encrypt and decrypt communications. The Foreground Suppressor component may communicate to and/or with other components in a component collection, including itself, and/or facilities of the like. Most frequently, the Foreground Suppressor component communicates with the Foreground Suppressor database, operating systems, other program components, and/or the like. The Foreground Suppressor may contain, communicate, generate, obtain, and/or provide program component, system, user, and/or data communications, requests, and/or responses.

Distributed Foreground Suppressors

The structure and/or operation of any of the Foreground Suppressor node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the Foreground Suppressor controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided.

Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), local and remote application program interfaces Jini, Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using standard development tools such as lex, yacc, XML, and/or the like, which allow for grammar generation and parsing functionality, which in turn may form the basis of communication messages within and between components. For example, a grammar may be arranged to recognize the tokens of an HTTP post command, e.g.:

w3c -post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., the SOAP parser) that may be employed to parse (e.g., communications) data. Further, the parsing grammar may be used beyond message parsing, but may also be used to parse: databases, data collections, data stores, structured data, and/or the like. Again, the desired configuration will depend upon the context, environment, and requirements of system deployment.

To address various issues related to, and improve upon, previous work, the application is directed to FOREGROUND SIGNAL SUPPRESSION APPARATUSES, METHODS, AND SYSTEMS. The entirety of this application (including the Cover Page, Title, Headings, Field, Background, Summary, Brief Description of the Drawings, Detailed Description, Claims, Abstract, Figures, Appendices, and any other portion of the application) shows by way of illustration various embodiments. The advantages and features disclosed are representative; they are not exhaustive or exclusive. They are presented only to assist in understanding and teaching the claimed principles. It should be understood that they are not representative of all claimed inventions. As such, certain aspects of the invention have not been discussed herein. That alternate embodiments may not have been presented for a specific portion of the invention or that further undescribed alternate embodiments may be available for a portion of the invention is not a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope of the invention. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like. As such, it should be understood that advantages, embodiments, examples, functionality, features, logical aspects, organizational aspects, structural aspects, topological aspects, and other aspects of the disclosure are not to be considered limitations on the disclosure as defined by the claims or limitations on equivalents to the claims.

Depending on the particular needs and/or characteristics of an Foreground Suppressor user, various embodiments of the Foreground Suppressor may be implemented that enable a great deal of flexibility and customization. However, it is to be understood that the apparatuses, methods and systems discussed herein may be readily adapted and/or reconfigured for a wide variety of other applications and/or implementations. The exemplary embodiments discussed in this disclosure are not mutually exclusive and may be combined in any combination to implement the functions of the Foreground Suppressor.

The invention claimed is:

1. A processor-implemented method for foreground signal suppression, the method comprising:

capturing a plurality of input signals using a plurality of sensors within a sound field;

subjecting each input signal to a short-time Fourier transform to transform each signal into a plurality of non-overlapping subband regions;

estimating diffuseness of the sound field based on the plurality of input signals;

decomposing each of the plurality of input signals into a diffuse component and a directional component based on the diffuseness estimate;

applying a spatial analysis operation to filter the directional component of each of the plurality of input signals, wherein the spatial analysis operation includes applying a set of beamformers to the directional components to produce a plurality of beamformer signals; and processing the plurality of beamformer signals to produce a foreground channel for each of the plurality of sensors;

orthogonalizing each of the input signals with respect to the foreground channels to produce a background signal for each of the plurality of sensors, each of the background signals representative of at least a portion of a background scene of the sound field; and generating output signals for monophonic or multichannel reproduction based on the background signal for each of the plurality of sensors.

2. The method of claim 1, further comprising:

applying spatial filtering to each of the background signals to produce filtered signals, wherein the output signals correspond to the filtered signals; and transmitting the filtered signals to an output device configured to reproduce the background scene of the sound field.

3. The method of claim 1, wherein processing the plurality of beamformer signals comprises, for each frequency element, only retaining the beamformer signal with a highest energy with respect to other signals at that frequency bin.

4. The method of claim 1, further comprising subjecting the foreground channels to an enhancement approach that discards frequency components whose energy is lower than a predetermined threshold.

5. The method of claim 4, wherein the predetermined threshold is based on an estimation of a background spectral floor, which is defined using the diffuse component of the input signals.

6. The method of claim 5, wherein the background spectral floor is averaged over all frequency bins in a same subband region.

7. The method of claim 1, wherein processing the plurality of beamformer signals comprises performing Principal Component Analysis on the beamformer signals.

8. The method of claim 1, wherein the diffuseness of the sound field is estimated based on a magnitude square coherence between two input signals.

9. The method of claim 1, wherein the set of beamformers comprises fixed filter-sum superdirective beamformers.

10. A system for foreground signal suppression, the system comprising:

a plurality of sensors configured to capture a plurality of input signals within a sound field;

a processor interfacing with the plurality of sensors and configured to receive the plurality of input signals;

an STFT module interfacing with the processor and configured to apply a short-time Fourier transform to transform each signal into a plurality of non-overlapping subband regions;

a diffuseness estimator interfacing with the processor and configured to estimate the diffuseness of the sound field based on the plurality of input signals;

a signal decomposer interfacing with the processor and configured to decompose each of the plurality of input signals into a diffuse component and a directional component based on the diffuseness estimate;

a spatial analyzer interfacing with the processor and configured to apply a spatial analysis operation to filter the directional component of each of the plurality of input signals, wherein the spatial analysis operation includes applying a set of beamformers to the directional components to produce a plurality of beamformer signals; and a beamformer processor module configured to process the plurality of beamformer signals to produce a foreground channel for each of the plurality of sensors; and an orthogonalizer configured to orthagonalize each of the input signals with respect to the foreground channels to produce a background signal for each of the plurality of sensors, each of the background signals representative of at least a portion of a background scene of the sound field, wherein output signals for monophonic or multichannel reproduction are generated based on the background signal for each of the plurality of sensors.

11. The system of claim 10, further comprising a spatial filtering module configured to:

apply spatial filtering to each of the background signals to produce filtered signals; and transmit the filtered signals to an output device for reproducing the background scene of the sound field.

12. The system of claim 11, wherein the beamformer processor module is configured to retain, for each frequency element, only the beamformer signal with a highest energy with respect to other signals within a same frequency bin.

13. The system of claim 11, wherein the beamformer processor module is configured to discard frequency components whose energy is lower than predetermined threshold.

14. The system of claim 13, wherein the predetermined threshold is based on an estimation of a background spectral floor, which is defined using the diffuse component of the input signals.

15. The system of claim 14, where in the background spectral floor is averaged over all frequency bins in predetermined same subband region.

16. The system of claim 11, wherein the beamformer processor module is configured to perform Principal Component Analysis on the beamformer signals.

17. A non-transitory computer-readable medium storing instructions that, when executed by one or more processors, cause the one or more processors to perform operations for capturing and reproducing spatial sound with foreground suppression, the operations comprising:

capturing a plurality of input signals using a plurality of sensors within a sound field;

subjecting each input signal to a short-time Fourier transform to transform each signal into a plurality of non-overlapping subband regions;

estimating the diffuseness of the sound field based on the plurality of input signals;

decomposing each of the plurality of input signals into a diffuse component and a directional component based on the diffuseness estimate;

applying a spatial analysis operation to filter the directional component of each of the plurality of input signals, wherein the spatial analysis operation includes applying a set of beamformers to the directional components to produce a plurality of beamformer signals;

processing the plurality of beamformer signals to produce a foreground channel for each of the plurality of sensors;

orthogonalizing each of the input signals with respect to the foreground channels to produce a background signal for each of the plurality of sensors;

applying spatial filtering to each of the background signals to produce filtered signals;

transmitting the filtered signals to an output device configured to reproduce a background scene of the sound field.

* * * * *